US011255526B2

(12) United States Patent
Stegeman

(10) Patent No.: US 11,255,526 B2
(45) Date of Patent: Feb. 22, 2022

(54) FLEXIBLE LIGHTING AND UNIVERSAL MOUNTING SYSTEM FOR MUNICIPAL UTILITY POLES

(71) Applicant: Labyrinth Technologies, LLC, Hazelwood, MO (US)

(72) Inventor: Theodore J. Stegeman, Hazelwood, MO (US)

(73) Assignee: Labyrinth Technologies, LLC, Hazelwood, MO (US)

( * ) Notice: Subject to any disclaimer, the term of this patent is extended or adjusted under 35 U.S.C. 154(b) by 0 days.

(21) Appl. No.: 17/037,918

(22) Filed: Sep. 30, 2020

(65) Prior Publication Data

US 2021/0010664 A1 Jan. 14, 2021

Related U.S. Application Data

(63) Continuation of application No. 16/822,147, filed on Mar. 18, 2020, now Pat. No. 10,823,380, which is a continuation of application No. 16/448,941, filed on Jun. 21, 2019, now Pat. No. 10,697,620.

(60) Provisional application No. 62/688,194, filed on Jun. 21, 2018, provisional application No. 62/792,213, filed on Jan. 14, 2019.

(51) Int. Cl.

| | |
|---|---|
| ***F21V 21/32*** | (2006.01) |
| ***F21S 8/08*** | (2006.01) |
| *F21W 131/103* | (2006.01) |

(52) U.S. Cl.

CPC ..... *F21V 21/32* (2013.01); *F21S 8/085* (2013.01); *F21W 2131/103* (2013.01)

(58) Field of Classification Search

CPC ..... F21V 21/32; F21V 15/01; F21V 21/116; F21S 8/085; F21S 4/26; F21S 8/086; F21W 2131/103; F21Y 2107/70; F21Y 2115/10; F21Y 2113/20

See application file for complete search history.

(56) References Cited

U.S. PATENT DOCUMENTS

| | | | | |
|---|---|---|---|---|
| 2004/0100793 | A1 | 5/2004 | Monitto | |
| 2007/0171640 | A1* | 7/2007 | Sloan | F21S 4/20 362/240 |
| 2010/0061095 | A1* | 3/2010 | Hoffmann | F21S 8/022 362/235 |

(Continued)

FOREIGN PATENT DOCUMENTS

| | | | | |
|---|---|---|---|---|
| CA | 2609455 | A1 * | 11/2006 | F21S 4/26 |
| CN | 101113806 | A * | 1/2008 | F21S 4/26 |

OTHER PUBLICATIONS

Marcelo Schupbach, "Next-Gen LED Lighting Designs Driven by SiC Devices", 2015, www.wolfspeed.com.

*Primary Examiner* — Donald L Raleigh
(74) *Attorney, Agent, or Firm* — Lewis Rice LLC

(57) ABSTRACT

A flexible lighting tube and universal architectural mounting system for lighting upon municipal utility poles. The mounting system is a bracket having the form of an inverted track to receive a lighting tube. The bracket may have a base and plurality of flanges used to either hold the lighting tube or attach to a pole. The base and flanges form a U-like shape and are made from a flexible material allowing the bracket to be shaped to conform to a pole to which it attaches. A foam layer may be inserted between the bracket and tube to inhibit unintended disconnection.

19 Claims, 6 Drawing Sheets

(56) References Cited

U.S. PATENT DOCUMENTS

| | | | | |
|---|---|---|---|---|
| 2012/0063125 | A1* | 3/2012 | Quaal | A47F 3/001 362/125 |
| 2014/0071677 | A1 | 3/2014 | Pickard et al. | |
| 2014/0211487 | A1 | 7/2014 | Spiro | |
| 2015/0062890 | A1* | 3/2015 | Camarota | F21K 9/66 362/223 |
| 2015/0115807 | A1 | 4/2015 | Schroder et al. | |
| 2015/0362172 | A1 | 12/2015 | Gabriel et al. | |
| 2016/0320049 | A1 | 11/2016 | Bears | |
| 2017/0146223 | A1 | 5/2017 | Chaoua et al. | |
| 2018/0288860 | A1 | 10/2018 | Vendetti et al. | |
| 2019/0017667 | A1 | 1/2019 | Mitchell et al. | |
| 2019/0174608 | A1 | 6/2019 | Verfuerth | |
| 2019/0380191 | A1 | 12/2019 | Wu et al. | |

* cited by examiner

FIG. 1
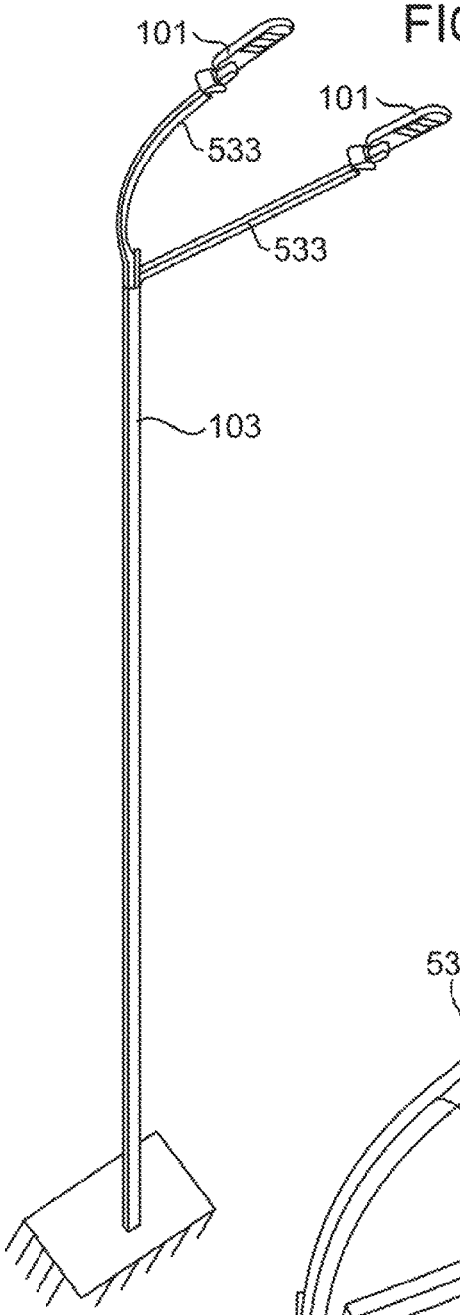
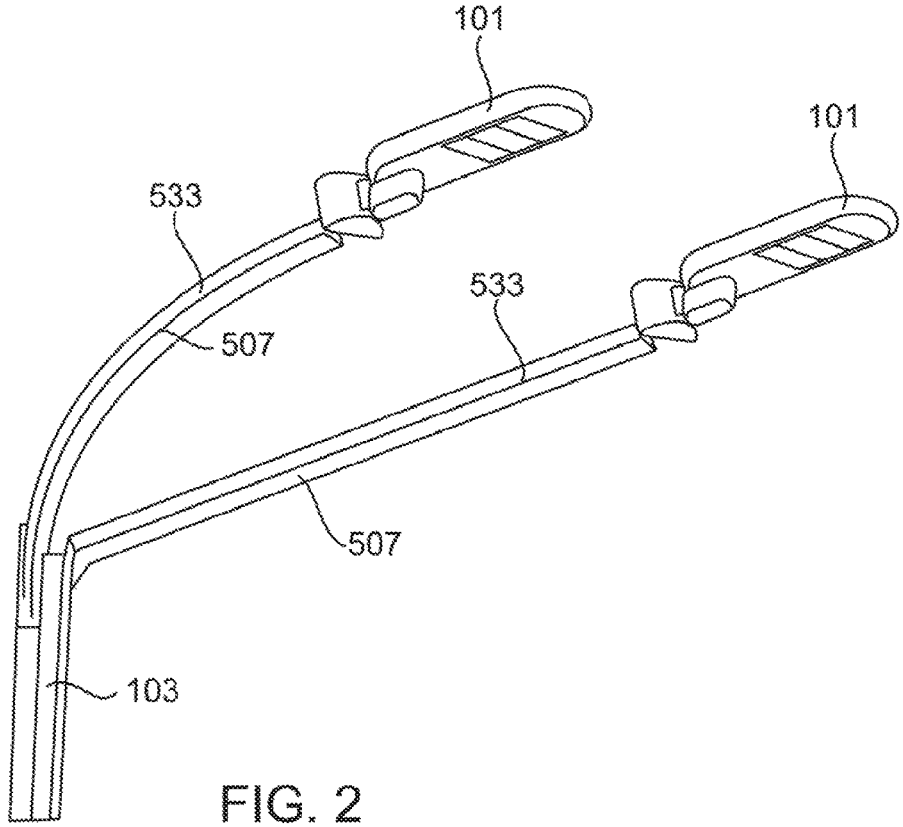
FIG. 2

FLEXIBLE LIGHTING AND UNIVERSAL MOUNTING SYSTEM FOR MUNICIPAL UTILITY POLES

CROSS-REFERENCE TO RELATED APPLICATIONS

This application is a Continuation of U.S. application Ser. No. 16/822,147, filed Mar. 18, 2020, which is a continuation of U.S. application Ser. No. 16/448,941, filed Jun. 21, 2019, and now issued Jun. 30, 2020 as U.S. Pat. No. 10,697,620, which claims the benefit of U.S. Prov. Pat. App. Ser. No. 62/688,194, filed Jun. 21, 2018, and which claims the benefit of U.S. Prov. Pat. App. Ser. No. 62/792,213, filed Jan. 14, 2019. The entire disclosures of all of these documents are incorporated herein by reference.

BACKGROUND OF THE INVENTION

Field of the Invention

This disclosure is related to the field of municipal illumination and illumination equipment, and more specifically to mounting systems for lighting upon municipal utility poles arms.

Description of the Related Art

Darkness has dogged people for millennia. Some people use darkness for good while others do not. Darkness limits the ability of diurnal people to do things. In ancient times, people dispelled darkness with various torches and cauldrons. In more recent centuries, people developed candles, firebrands, and pots of pitch. These plant and animal based light sources worked to a point. These light sources had a limited lifespan and select persons would have to replenish them.

Such light sources were often carried by a person to illuminate his path, usually when walking. For some persons, such light sources illuminated the path of horses and oxen. Alas, persons of lesser means would walk along streets and paths in darkness. Untold horrors would befall those who walked in darkness.

Municipal leaders in the last two centuries determined that lighting of streets protects those who walk upon them without their own light source. A recent jurist quipped that "light is the best policeman." Municipal leaders realized street lighting also reduced crime. In the last century, various cities and then towns and villages developed lighting systems for their streets. Such systems began with gas lamps lit by a lamplighter and evolved into are lighting.

In recent decades, city lighting systems have become electrified across entire cities using alternating current. Thomas Edison developed the light bulb and the power generation and distribution system to deploy them widely across a city. Cities have emplaced various lighting systems from various manufacturers over the years. Like other devices, lighting systems face the elements and hazards of time. Eventually, a lighting system calls for maintenance. Many lighting systems, being under municipal ownerships, compete with other programs for funding. Various reports have noted that many years, often a decade, may elapse before a city employee inspects a street light. In some cities, street lights by the thousands or by at least 20% do not work. Once more, darkness like in olden times retakes parts of cities.

A city lighting system has a fleet of poles deployed across a city following various building codes and lighting codes adopted by a city. A street will have so many light poles per linear mile. A typical street light begins with a pedestal installed near a road. Electric utility service provides a power line to the pedestal. The light continues with a pole placed upon the pedestal. The pole may be concrete, galvanized steel, or other alloy suitable to long exposure to the elements and vehicles. The pole has a slender elongated form that tapers upwardly. The pole has two ends with one securing to the pedestal and the other end elevated above the street, typically at least twenty feet for truck clearance. The elevated end has an arm, commonly called a cobra arm, that extends outwardly and over a street and possibly adjacent sidewalk. The cobra arm has a light fixture upon its end above the street. The light fixture receives power from the utility service line and turns on and off utilizing a solar cell. A typical street light operates with some autonomy.

In recent years, street light arms have acquired a pleasing curved shape. Such arms have the name of cobra arm for a similarity of appearance to a snake of the same name. At the end of the cobra arms, lights have had various forms with the sodium vapor light having popularity at present. Such lights provide a damp orange glow, pleasing to the eye at night without blinding pedestrians and motorists near such lights. Such lights have their operating costs and their maintenance increases as they near their design life of around 18,000 operating hours.

Cities find it increasingly desirable to improve the aesthetics of cities through the use of decorative lighting, which supplements a primary light. Due to the widespread presence of light poles in a city, which are already elevated above the street and have access to power and other control circuitry, it is logical to add decorative lighting to existing light poles. The affordability and long operational life of LEDs makes them a natural choice for this role.

However, retrofitting a light pole is not simple. Even within a single city, and sometimes within a single city block, light poles and arms may take a variety of forms and shapes. This means the city must stock a number of different types of mounting systems for each different light pole. Cities also generally have incomplete or porous inventories of light poles and types. This means that when crews are sent out to retrofit poles with decorative lighting, the crews may not know in advance what type of poles they will be working with each day. They then must either bring along a wide variety of mounting systems, some of which they may not need, only to find out they did not bring enough of another type that they do need. The same basic problem arises in the context of repairing and replacing aging or broken brackets or lights.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Described herein, among other things, is a universal architectural mounting system for lighting upon cobra arms has been described. The universal architectural mounting system for lighting upon cobra arms is uniquely capable of continuously following the arcuate shape of a cobra arm and receiving an existing LED lighting strip. The universal architectural mounting system for lighting upon cobra arms and its various components may be manufactured from many materials, including but not limited to, polymers, polyethylene, polypropylene, nylon, ferrous and non-ferrous metals, their alloys, and composites.

Also described herein, among other things, is a municipal illumination system comprising: a mounting bracket comprising a generally rectangular elongated body having a first surface and an opposing second surface, and a first flange extending perpendicularly from the first surface at a first side of the body, and an opposing second flange extending perpendicularly from the first surface at a second side of the body opposing the first side, the first flange and second flange being generally parallel and each comprising an aperture therethrough; and a light tube comprising: a generally rectangular elongated base element having a first end and an opposing second end, and a channel extending therethrough from the first end to the second end, the channel sized and shaped to accepted a light strip; a diffuser attached to a first surface of the light tube and extending from the first end to the second end; a light strip disposed in the channel and extending from the first end to the second end; wherein the light tube is sized and shaped for affixation to the mounting bracket by a second surface of the light tube opposing the first surface being affixed to the second surface of the mounting bracket.

In an embodiment of the municipal illumination system, the second surface of the light tube is affixed to the second surface of the mounting bracket.

In another embodiment, the municipal illumination system further comprises a retention element having a top side and an opposing bottom side, the retention element being sized and shaped for affixation to the mounting bracket by the bottom side being affixed to the second surface of the mounting bracket, and the retention element being sized and shaped for affixation to the light tube by the second surface of the light tube being affixed to the top side of the retention element.

In a further embodiment of the municipal illumination system, the retention element comprises foam.

In another embodiment, the municipal illumination system further comprises an attaching element adapted to attach the mounting bracket to a municipal light pole arm by the attaching element passing through each of the apertures and enveloping the municipal light pole arm.

In a further embodiment of the municipal illumination system, the attaching element comprises a metal clamp.

In another embodiment of the municipal illumination system, the light strip comprises a double-LED light strip.

In another embodiment, the municipal illumination system further comprises an endcap sized and shaped to attach to the first end of the light tube by a cover of the endcap enclosing a portion of the light tube at the first end.

In a further embodiment of the municipal illumination system, the endcap is attached to the first end of the light tube by the cover enclosing the portion of the light tube at the first end.

In a still further embodiment of the municipal illumination system, the endcap is attached to the mounting bracket using one or more screws.

In another embodiment of the municipal illumination system, the endcap comprises a wiring aperture extending therethrough.

Also described herein, among other things, is a mounting system for lighting upon cobra arms of a street light, comprising: a track having an elongated arcuate form, a base and a mutually parallel and spaced apart flanges, the base having an outer surface adapted to connect continuously upon a cobra arm; at least one pinch clip, the at least one pinch clip having a slender elongated form and two spaced apart tips, the tips abutting the flanges; and, wherein the track is adapted to receive a strip of light emitting diode lighting within the flanges and the base.

In an embodiment, the mounting system further comprises: the track having an inverted U like shape, the flanges including a left flange and a right flange; and, the at least one pinch clip having a first tip and a second tip, the first tip and the second tip cooperatively compressing the left flange and the right flange respectively thus frictionally retaining a strip of light emitting diode lighting within the system.

In another embodiment, the track and the at least one pinch clip are opaque.

In an embodiment, the mounting system further comprises: the at least one pinch clip including a plurality of the pinch clips spaced upon the track.

BRIEF DESCRIPTION OF THE DRAWINGS

FIG. 1 illustrates a perspective view of a light pole;

FIG. 2 illustrates an enlarged perspective view of alight pole;

DESCRIPTION OF THE PREFERRED EMBODIMENT(S)

Figure 3:
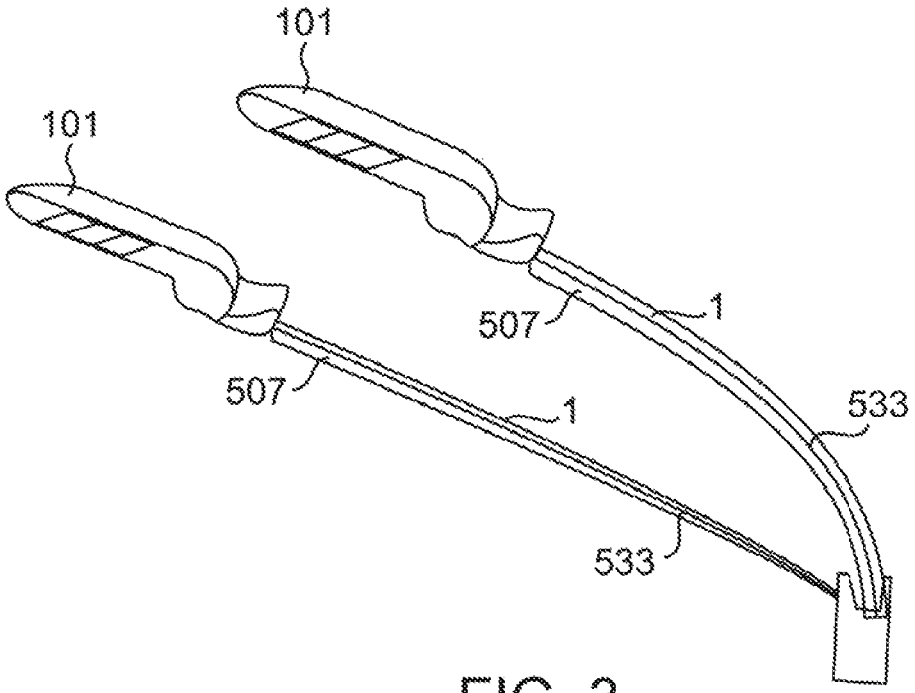
FIG. 3 shows a perspective view of an embodiment of a universal mounting system as described herein deployed upon a municipal utility pole arms.

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Generally, described herein is a flexible and controllable municipal light tube and a corresponding universal architectural mounting system for installing such lighting upon a municipal utility pole. The mounting system includes generally a flexible, inverted track form that receives a light, and has a retention system for affixing a light to the mount, and an attaching system for affixing the mount to a light pole.

A first embodiment is shown in FIGS. 1, 2, 3, and 4. In the first embodiment, the mounting system has a base, a left flange, and a mutually parallel and spaced apart right flange, the three combining into an inverted U-like shape. The base may have a width generally about, or at least, twice that of a flange. The flanges may cabin a LED strip within the mount and prevent lateral illumination from it. The base, the left flange, and the right flange are opaque and permit some play between the strip and mounting system. To restrict that play, a pinch clip with a first tip and a spaced apart second tip that both impart a compressive force upon the flanges may be used. The pinch clip may have a slender elongated form. The compressive force arises from deflection of the pinch clip and imparts a gentle squeeze upon the two flanges, thus retaining the strip within the mounting system and along the arm. The base may be at least twice as wide as a flange, mounting clips, a plurality of pinch clips spaced regularly, flanges sized to strip depth, and an alternate adhesive connection.

FIG. 1 shows a perspective view of a portion of alight 101 outwardly and coaxial with a cobra arm 533 and a first embodiment of the mounting system installing upon an end of the cobra arm 533 and receiving the light 101. The cobra arm 533 attaches to a light pole 103 erected upon a sidewalk or other location for illumination by light 101. A strip of light emitting diode lighting 507 connects to the cobra arm 533 along at least a portion of its length utilizing the depicted embodiment.

FIG. 2 has an enlarged perspective view of two lights 101 upon the cobra arms 533. The cobra arms 533 have a generally elongated shape with an arcuate form. The two cobra arms 533 extend to their maximum separation at the lights 101 upon 5 their ends and then gradually curve to a common point upon the pole 103. Each cobra arm 533 has a strip of LED 507 connected to it upon its length. Each cobra arm 533 has two spaced apart ends, a free end to which a light 101 connects, and an opposite fixed end with which the cobra arm 533 connects to the pole 103.

FIG. 3 shows a perspective view of the first embodiment deployed upon a pair of cobra arms 533. The invention has a generally elongated form and retains a strip of LED lighting 507 along its length on each of the cobra arms 533. The depicted mounting system permits uninterrupted electrical operation of the LED lighting strips 507. The invention 1 provides a continuous smooth connection of the strips 507 along the arcuate shape of the cobra arms 533.

Figure 4:
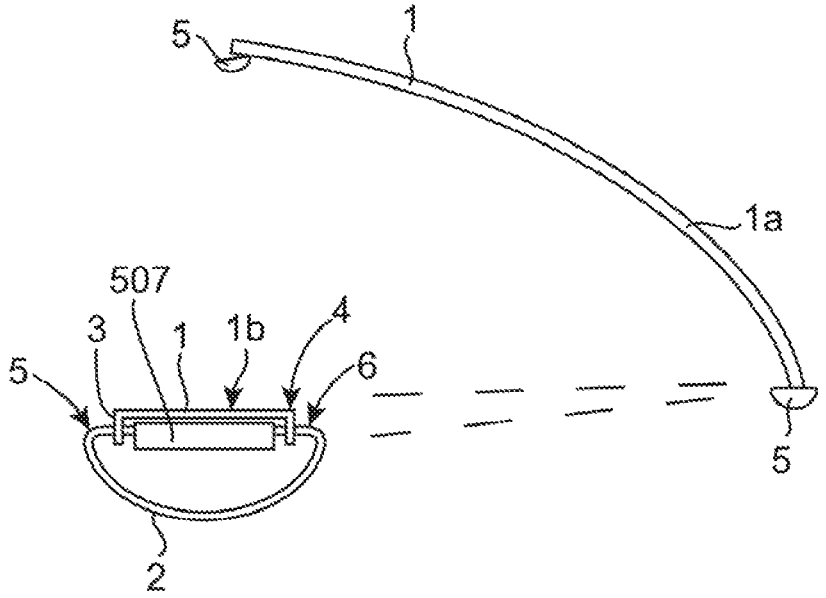
FIG. 4 shows a side view of the embodiment of FIG. 3 with an inset end view.

More particularly shown in FIG. 4, the depicted mounting system 1 has an elongated, arcuate, form with two ends, similar to a track. The depicted mounting system receives a strip of LED 507 placed within it and then the depicted mounting system allows for clear transmission of light from the strip 507. The depicted mounting system has an opaque outer surface, shown as at 1*a*, which abuts the cobra arm 533 itself during installation and later usage. The outer surface preferably provides continuous contact of the depicted mounting system to a cobra arm 533. Though FIG. 4 shows one mounting system, a typical cobra arm installation upon a pole calls for two. FIG. 4 also has a detailed partial view shown of an end. The depicted mounting system 1 has a generally inverted truncated U-like shape. The depicted mounting system functions as a track that receives an LED strip 507. The depicted mounting system has a base 1*b*, here shown as flat, a left flange 3 and a mutually parallel and spaced apart right flange 4. The left flange 3 and the right flange 4 both extend in the same direction. The base has a width generally at least twice that of either flange. The left flange 3 and the right flange 4 cabin an LED strip 507 placed within the depicted mounting system and prevent lateral illumination from the strip 507. The base, the left flange 3, and the right flange 4 generally have an opaque construction. Formed in the U-like shape, the left flange 3, the right flange 4, and the base permit some play between a strip 507 and the depicted mounting system 1 during installation. The depicted mounting system includes a pinch clip 2 of a generally slender, elongated form with two ends. The ends include a first tip 5 and a spaced apart second tip 6. The first tip 5 abuts the left flange 3 and the second tip 6 abuts the right flange 4 and both tips impart a compressive force upon their respective flanges. The compressive force arises from deflection of the pinch clip 2 and imparts a gentle squeeze upon the two flanges, thus retaining the strip 507 within the mounting system during its usage. The depicted mounting system 1 includes a plurality of pinch clips 2 spaced along its length to counteract the weight of the strip 507 as needed. In an alternate embodiment, the depicted mounting system 1 secures the strip 507 within itself using an all-weather adhesive.

FIGS. 5, 6, 7, and 8 depict an alternative embodiment of a universal mounting system, and a flexible light tube. The depicted light tube 501 is generally in a configuration of an oblate half-cylinder, comprising a base element 509 and a diffuser 513. The depicted base element 509 is a generally flat, elongated element in the configuration of a rectangular prism extending the length of the tube 501 along its major axis, and having a hollow channel 511 therethrough having a generally rectangular cross-section sized and shaped to accept a light strip 507. Attached to a top side of the base element 509 is an elongated diffuser generally in the configuration of an arch defining an elongated hollow channel 515 between the diffuser 513 and base element 509 extending the length of the tube 501.

The tube 501 and its elements are generally constructed from flexible, weatherproof or weather resistant materials, such as rubbers and polymers. The base element 509 may be fully or generally opaque, and may be a different material and/or opacity from the diffuser 513. The layer of material between the light channel 511 and the diffuser channel 515 is generally opaque, causing light emitted by a light strip 507 disposed in the light channel 511 to transmit into the diffuser channel 515, and from there to transmit through the diffuser 513 walls to the exterior of the tube 501.

The depicted light strip 507 is a double-LED light strip, having two runs of corresponding side-by-side LED lights disposed in a series along the length of the light strip 507. When assembled, the light strip 507 is disposed in the light channel 511 and generally runs the length of the tube 501, causing LEDs to be disposed along most or all of the length of the tube 501, and possibly longer. Electrical power and other communications may be provided to the light strip 507 via a wired connection 510 or one or more leads 510 extending therefrom, which are then connected to other components for powering and/or controlling the lights.

The shape and contour of the diffuser 513 in any given embodiment may be adapted to cause a particular type, degree, or amount of light diffusion from the light strip 507 disposed in the light channel 511. In the depicted embodiment, an arcuate configuration is shown to cause light dispersion in about a 180-degree are from the plane of the base element 509, but other shapes and opacities may be used in other embodiments depending upon the particular design or aesthetic purposes of the embodiment.

Figure 5:
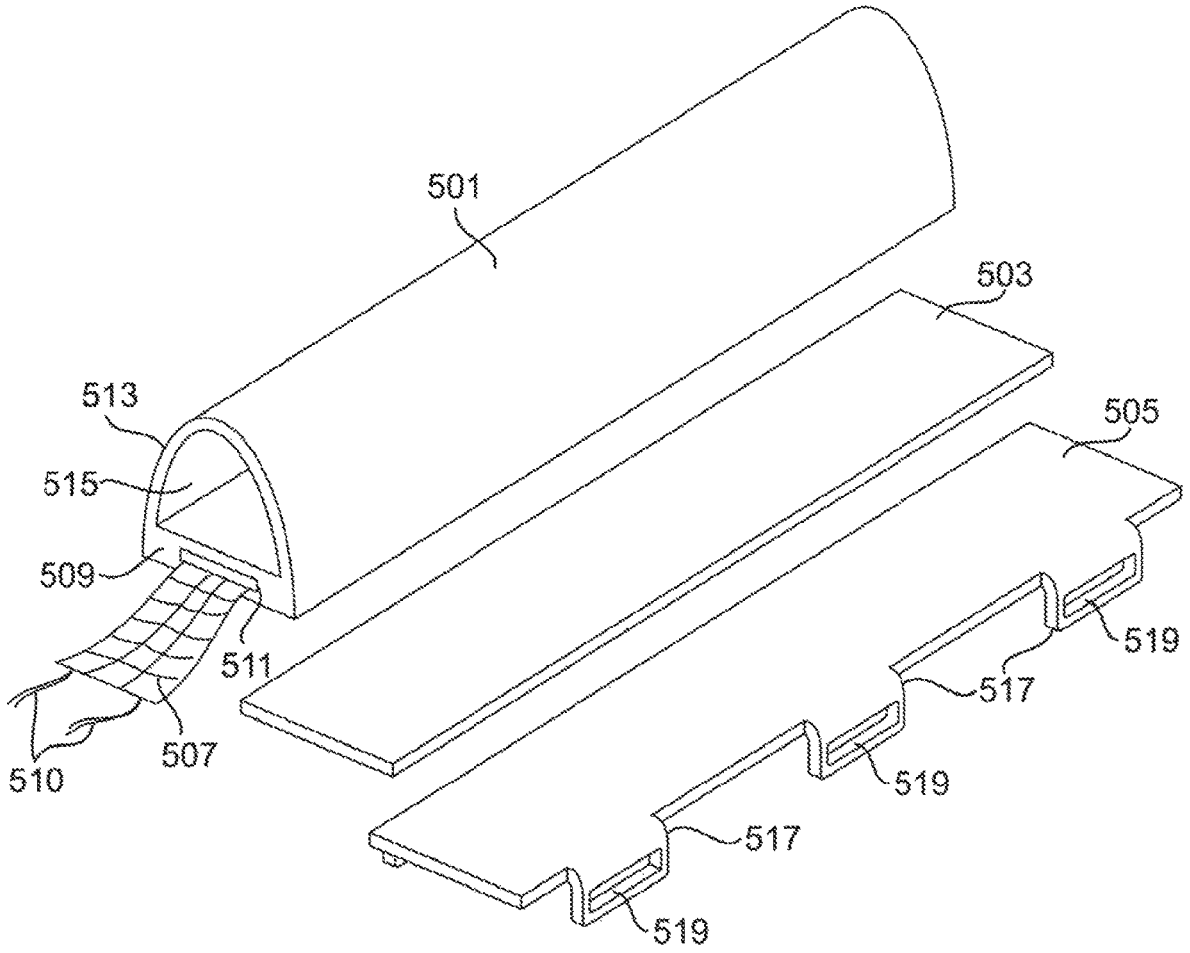
FIG. 5 shows a perspective exploded view of an embodiment of a flexible light and universal mounting system as described herein.

Also depicted in FIG. 5 is a mounting bracket 505 sized and shaped for attaching a corresponding light tube 501. The depicted mounting bracket 505 is generally an elongated, flexible base element having at least one flange 517 extending generally perpendicularly therefrom. In the depicted embodiment, a plurality of flanges 517 are shown along the length of the base. Each of the depicted flanges 519 has an aperture therethrough for using an attaching element 531 to affix the bracket 505 to a light pole 533.

It is generally anticipated that flanges 517 will be disposed in opposing, generally parallel pairs extending in the same direction from opposing sides of the bracket 505 body. Further, the apertures 519 for any given pair of flanges are generally coordinated to define a rectangular plane or prism, such that an attaching element 531 passed perpendicularly through one aperture 519 of a flange 517 may proceed directly across the body of the bracket 505 to pass through the aperture 519 of the corresponding, opposing flange 517.

The depicted base is generally manufactured from a sheet of stainless steel or another flexible, durable metal that may be bent or formed to correspond to the contour of a municipal utility pole arm. The length of the bracket 505 is generally about the same length as the length of the light tube 501 to be attached to it, but in an embodiment, may be longer or shorter as needed. The light tube 501 may be affixed to the bracket 505 via a firm, weatherproof or weather resistant adhesive.

Figure 6:
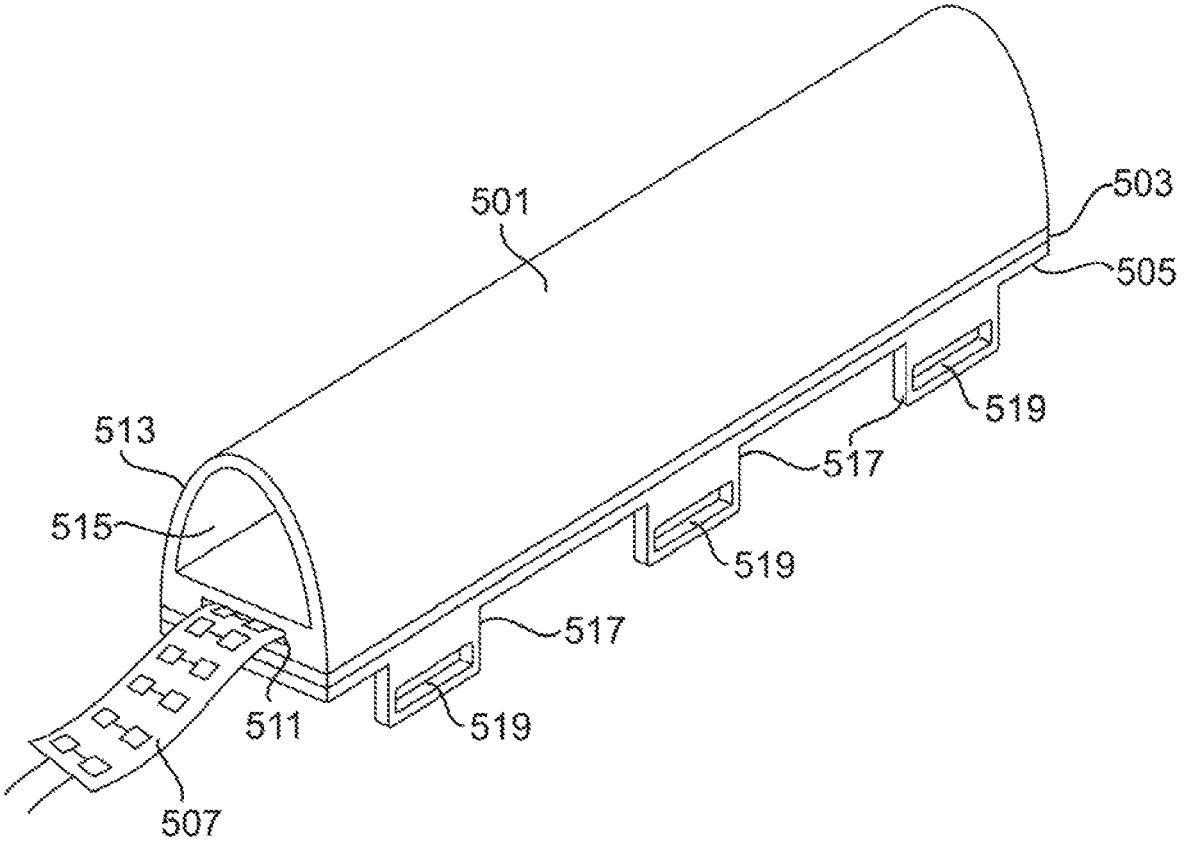
FIG. 6 shows a perspective assembled view of the embodiment of FIG. 5.

As seen in FIG. 6, the depicted light tube 501 is attached on a side of the bracket 505 opposing the direction in which the flanges 517 extend. As explained with respect to FIG. 8, this prevents the flanges from inhibiting light dispersion and facilitates attachment to a light arm 533.

In an embodiment, a retention element 503 may be disposed between the bracket 505 and light tube 501. In such an embodiment, the retention element 503 may be affixed to the bracket 505 via a durable, weatherproof or weather resistant adhesive, and the light tube 501 may then be attached to the retention element 503, also via a durable, weatherproof or weather resistant adhesive. In the depicted embodiment, the retention element 503 is a durable, weatherproof and/or weather resistant foam. It is believed that by interposing a foam retention element 503 between the bracket 505 and light tube 501, unintended detachment is inhibited. FIG. 6 depicts the embodiment of FIG. 5 in an assembled configuration.

Figure 7:
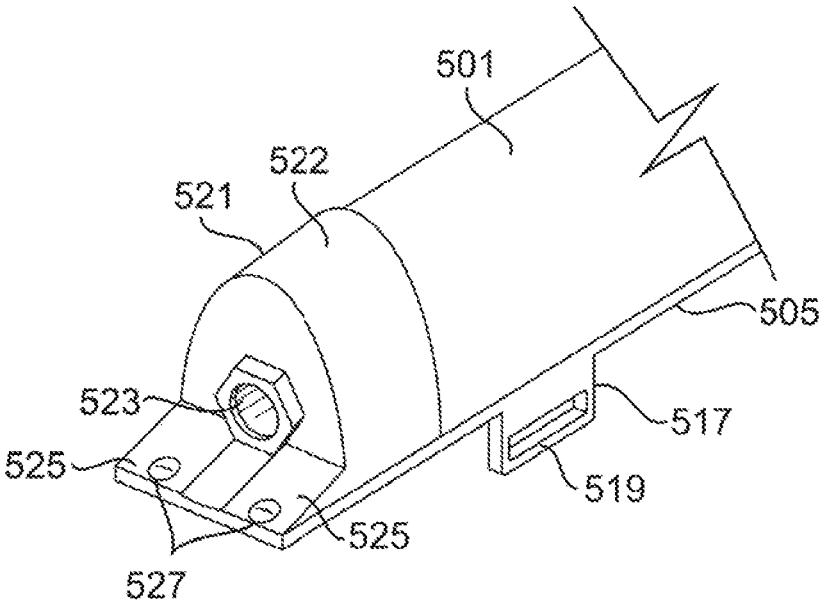
FIG. 7 shows a perspective view of the embodiment of FIG. 6 with an endcap installed on an end of the assembly.

To further inhibit unintended detachment, which could cause a light tube 501 to fall on pedestrians or vehicles, an endcap may be installed. FIG. 7 depicts an embodiment utilizing such an endcap 521. The depicted endcap 522 is sized and shaped to be affixed to an end of the assembled mounting bracket 505/light tube 501 combination. The illustrative embodiment of FIG. 7 omits the retention element 503, but it will be clear to a person of ordinary skill in the art that the endcap 521 may be sized and shaped to accommodate an embodiment including the retention element 503.

The depicted endcap 521 is made from a hardened, durable material, and generally an inflexible or rigid material, such as a hard plastic. The depicted endcap includes a cover element 522 that surrounds the diffuser 513 at an end of the assembled bracket 505/tube 501, and holds it snugly within the cover 522 to inhibit slippage or detachment. The endcap 521 may then be attached to the bracket 505 using hardware, such as a pair of screws 527 passed through openers or grooves in flanges 525 of the endcap 521. This provides a more sure method of affixation and, if the adhesive were to fail, inhibits the light tube 501 from fully detaching from the bracket 505 and potentially injuring people or damaging property.

The depicted endcap 521 further comprises a wiring channel 523 passing axially through the endcap 521. This channel 523 allows the wires or connections of the light strip 517 to be passed through the endcap 521 and connected to power and control components. This channel may include a gasket or other weatherproofing elements to inhibit penetration by moisture and/or debris.

Figure 8:
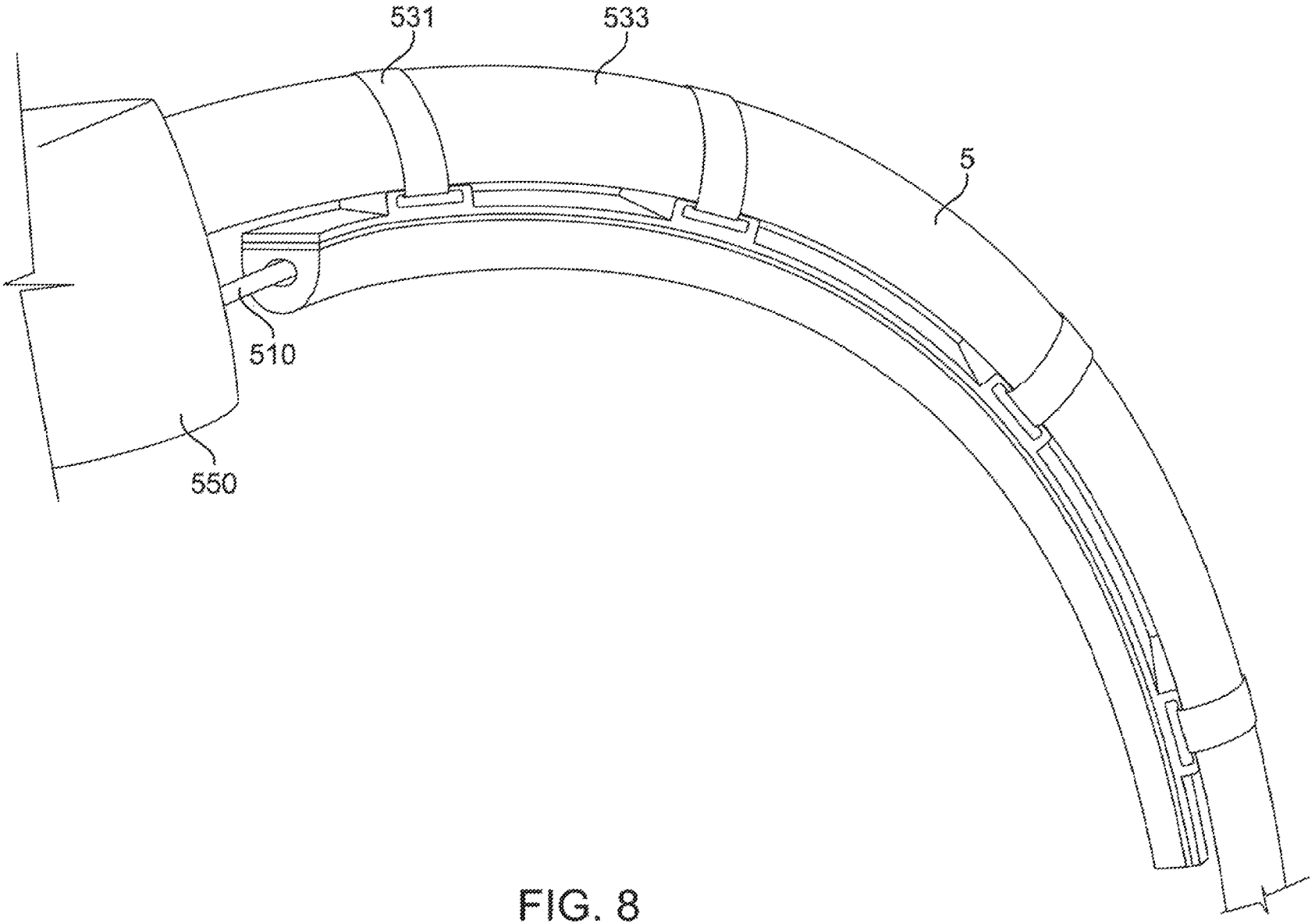
FIG. 8 shows a perspective view of the embodiment of FIG. 6 installed on a municipal light pole arm.

FIG. 8 depicts the assembled embodiment affixed to the arm 533 of a municipal utility pole. In the depicted embodiment, the assembled device is affixed by use of an attaching element 531 which passes through the apertures 519 in corresponding flanges 517 and is then attached to the arm 533. This attaching element 531 may be anything from a simple industrial tape to metal strip, similar in nature to a ducting clamp. In the depicted embodiment, the bracket 505 is attached at each of a set of corresponding flanges 517 to provide a sure connection and inhibit the assembled device from slipping down the arm 533. The attaching element 531 may be supplemented by an adhesive or high-friction pad to further inhibit slippage.

As can be seen in FIG. 8, in this embodiment, the flanges are disposed towards the light arm 533 and the light tube 501 is disposed on the opposing side of the bracket 505, projecting light outward and generally downward from the light arm 533 toward the land below. The connecting lines 510 for power and control may then be run to a device or apparatus 550 containing appropriate power supply and control components.

Because the bracket 505 and tube 501 are both flexible, the assembled device may be manufactured to the desired length of the light arm 533 and bent or formed on-site during installation to correspond to the shape or contour of the arm 533. Likewise, the attaching element 531 may be a flexible and adjustable element, allowing a connection regardless of the shape of the cross-section of the light arm 533, or even variations in the size or shape of the light arm 533 along its length.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

Throughout this disclosure, terms such as "generally," "about," and "approximately" may be used, such as, but not necessarily limited to, with respect to geometric terms, including shapes, sizes, dimensions, angles, and distances. One of ordinary skill in the art will understand that, in the context of this disclosure, these terms are used to describe a recognizable attempt to conform a device or component to the qualified term. By way of example and not limitation, components described as being "generally coplanar" will be recognized by one of ordinary skill in the art to not be actually coplanar in a strict geometric sense because a "plane" is a purely geometric construct that does not actually exist and no component is truly "planer," nor are two components ever truly coplanar. Variations from geometric descriptions are unavoidable due to, among other things, manufacturing tolerances resulting in shape variations, defects, imperfections, non-uniform thermal expansion, natural wear, and other deformations. Further, there exists for every object a level of magnification at which geometric descriptors no longer apply due to the nature of matter. One of ordinary skill in the art will understand how to apply relative terms such as "generally," "about," and "approximately" to describe a range of variations from the literal geometric meaning of the qualified term in view of these and other considerations. Additionally, the use of the conjunctive and disjunctive should not necessarily be construed as limiting, and the conjunctive may include the disjunctive, and vice versa.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The invention claimed is:

1. A light tube comprising:

a base element generally in the configuration of an elongated rectangular prism having a first surface and an opposing second surface, said base element enclosing a channel through said base element, said channel generally in the configuration of a hollow elongated rectangular prism;

a light strip disposed in said channel; and a diffuser attached to said first surface;

wherein said base element, said light strip, and said diffuser comprise a flexible construction such that said light tube is capable of with arcuate deformation, wherein said light tube is sized and shaped for affixation to a generally planar mounting bracket having a first surface and an opposing second surface, and at least one set of flanges extending generally perpendicularly from said first surface of said bracket, and said light tube is affixable to said mounting bracket by said second surface of said base element attaching to said second surface of said mounting bracket.

2. The light tube of claim 1, wherein said light strip comprises a double-LED light strip.

3. The light tube of claim 1, further comprising an endcap sized and shaped to attach to a first end of said light tube by a cover of said endcap enclosing a portion of said light tube at said first end.

4. The light tube of claim 3, wherein said endcap is attached to said first end of said light tube by said cover enclosing said portion of said light tube at said first end.

5. The light tube of claim 3, wherein said endcap comprises a wiring aperture extending therethrough.

6. The light tube of claim 5, wherein said light tube is adapted to receive power and control signals via wires disposed through said wiring aperture.

7. The light tube of claim 1, wherein said base element and said diffuser are generally in the configuration of an oblate half-cylinder.

8. The light tube of claim 1, wherein said channel has a generally rectangular cross-section.

9. The light tube of claim 1, wherein said diffuser generally in the configuration of an arch defining an elongated hollow diffuser channel between said diffuser and said base element.

10. The light tube of claim 1, wherein light emitted from said light strip transmits into said diffuser channel.

11. The light tube of claim 1, wherein diffuser comprises an arcuate shape and contour effective to cause light dispersion in about a 180-degree are from the major plane of said base element.

12. An illumination system comprising:

a light tube comprising:

a base element having a first surface and an opposing second surface, and a channel through said base element;

a light strip disposed in said channel; and a diffuser attached to said base element first surface;

wherein said base element, said light strip, and said diffuser comprise a flexible construction such that said light tube is capable of arcuate deformation; and a mounting bracket having a first surface and an opposing second surface, and at least one set of flanges extending generally perpendicularly outward from said first surface;

wherein said light tube is affixable to said mounting bracket by attaching said second surface of said base element to said second surface of said mounting bracket; and wherein said mounting bracket comprises a flexible construction such that when said light tube is affixed to said mounting bracket, said light tube and said mounting bracket are capable of arcuate deformation.

13. The illumination system of claim 12, wherein said light strip comprises a double-LED light strip.

14. The illumination system of claim 12, further comprising an endcap sized and shaped to attach to a first end of said light tube by a cover of said endcap enclosing a portion of said light tube at said first end.

15. The illumination system of claim 14, wherein said endcap is attached to said first end of said light tube by said cover enclosing said portion of said light tube at said first end.

16. The illumination system of claim 14, wherein said endcap comprises a wiring aperture extending therethrough.

17. The illumination system of claim 12, wherein said base element and said diffuser are generally in the configuration of an oblate half-cylinder.

18. The illumination system of claim 12, wherein said diffuser generally in the configuration of an arch defining an elongated hollow diffuser channel between said diffuser and said base element.

19. The illumination system of claim 12, wherein light emitted from said light strip transmits into said diffuser channel.

* * * * *